US008402677B2

(12) United States Patent
Houston

(10) Patent No.: US 8,402,677 B2
(45) Date of Patent: Mar. 26, 2013

(54) DEVICE FOR FOOTWEAR

(76) Inventor: Dennis Houston, Bronx, NY (US)

( * ) Notice: Subject to any disclaimer, the term of this patent is extended or adjusted under 35 U.S.C. 154(b) by 617 days.

(21) Appl. No.: 12/592,591

(22) Filed: Nov. 30, 2009

(65) Prior Publication Data

US 2011/0126429 A1 Jun. 2, 2011

(51) Int. Cl.
*A43B 23/24* (2006.01)

(52) U.S. Cl. ..... 36/136; 2/245; 40/636

(58) Field of Classification Search ..... 36/136, 36/132, 1, 50.1; 24/712.3, 712, 712.2; 2/245; 40/636

See application file for complete search history.

(56) References Cited

U.S. PATENT DOCUMENTS

| | | | | |
|---|---|---|---|---|
| 1,460,743 | A | 7/1923 | Binns | |
| 1,595,630 | A * | 8/1926 | Stockton | 36/50.1 |
| 1,640,104 | A * | 8/1927 | Stafford et al. | 36/58.5 |
| 1,778,413 | A * | 10/1930 | Ballou | 36/58.5 |
| 1,855,345 | A * | 4/1932 | Fischer, Jr. | 36/58.5 |
| 2,134,037 | A * | 10/1938 | Fenton | 24/674 |
| 2,861,311 | A * | 11/1958 | Kurland | 24/300 |
| 3,122,805 | A | 3/1964 | Hakim | |
| 3,701,572 | A * | 10/1972 | Velasquez | 24/712.4 |
| 4,210,983 | A * | 7/1980 | Green | 24/575.1 |
| 4,254,566 | A | 3/1981 | Haskell | |
| 4,485,529 | A | 12/1984 | Blum | |
| 4,597,198 | A | 7/1986 | Schweitzer | |
| 4,733,439 | A * | 3/1988 | Gentry | 206/338 |
| 5,209,000 | A | 5/1993 | Rowland | |
| 5,295,315 | A * | 3/1994 | Osawa et al. | 36/50.1 |
| 5,438,488 | A | 8/1995 | Dion | |
| 6,477,754 | B1 | 11/2002 | Alexander | |
| 7,819,721 | B1 * | 10/2010 | Messier | 450/86 |
| 2002/0116851 | A1 | 8/2002 | Ferguson | |
| 2006/0254089 | A1 * | 11/2006 | Frydlewski | 36/50.1 |
| 2007/0062217 | A1 * | 3/2007 | Graham | 63/3 |

FOREIGN PATENT DOCUMENTS

| | | | |
|---|---|---|---|
| JP | 04-089989 | U | 5/1992 |
| JP | 2006-181060 | A | 7/2006 |

* cited by examiner

*Primary Examiner* — Ted Kavanaugh
(74) *Attorney, Agent, or Firm* — Richard L. Miller

(57) ABSTRACT

An ornamental device for footwear of the type having a plurality of eyelets for a shoelace. The ornamental device comprises a mini bungee cord to engage with two opposite eyelets of the footwear. A decorative component is provided. A mechanism is for removably retaining the decorative component to center of the mini bungee cord.

2 Claims, 2 Drawing Sheets

DEVICE FOR FOOTWEAR

BACKGROUND OF THE INVENTION

1. Field of the Invention:

The present invention relates to a decorative attachments, and more particularly, an ornamental device for footwear.

1. Description of the Prior Art:

Numerous innovations for attachments for footwear having indicia thereon have been provided in the prior art that will be described. Even though these innovations may be suitable for the specific individual purposes to which they address, however, they differ from the present invention.

A FIRST EXAMPLE, U.S. Pat. No. 1,460,743, Issued on Jul. 3, 1923 to Binns et al. teaches an article of manufacture, a holder including a chambered receptacle, a flexible member attached to the receptacle, and means at the ends of the flexible member whereby the same may be detachably connected with a support affixed to the member with which the holder is to be associated.

A SECOND EXAMPLE, U.S. Pat. No. 3,122,805, Issued on Mar. 3, 1964, to Hakim teaches a protective receptacle for use in enclosing the knot of a shoelace which includes lace ends, the receptacle comprising a receptacle cup of shallow, generally cylindrical, tubular form; the cup having a bottom wall and a side wall having an outer edge; the side wall being externally threaded adjacent the outer edge; the cup having an internal volumne sufficient to completely enclose the knotted ends of the shoelace; the bottom wall having a pair of spaced openings formed therein to permit the lace ends to be drawn therethourgh prior to tying; the side wall having spaced apart slots formed therein opening through the outer edge thereof to permit entrance of the lace ends therethrough during tying; and closure means for the cup.

A THIRD EXAMPLE, U.S. Pat. No. 4,254,566, Issued on Mar. 10, 1981, to Haskell teaches a jogger and runner shoe identification device that is provided in the form of an elongate flexible and foldable sheet member having a weakened portion intermediate its length defining a bending line, at least one indicia receiving surface on said sheet whereby a wearer's name, address and pertinent medical information may be applied thereon and shoe lace receiving means in said sheet spaced from one end engageable upon laces of a shoe, the other end of the sheet being slidable beneath the laces between the laces and tongue of a shoe.

A FOURTH EXAMPLE, U.S. Pat. No. 4,485,529, Issued on Dec. 4, 1984, to Blum teaches a tying device for shoelaces which can be attached to the shoe and serves to maintain tied laces in their disposition. The device includes a body portion which remains exposed for viewing by the public and an eyelet member which receives the laces for securing the device to the shoe. An elastic band is integrated with the body portion and eyelet member for stretching over a shoelace knot to lock the device in place and prevent the shoelaces from becoming untied.

A FIFTH EXAMPLE, U.S. Pat. No. 4,597,198, Issued on Jul. 1, 1986, to Schweitzer teaches an ornamental attachment for mounting on lacing-type footwear has a support member extends under at least a portion of the lace longitudinally along the lacing opening of the article of footwear and face member having a display surface thereon extends over at least a portion of the lace. The ends of the support member are secured to the face member to provide a transverse passage through which the lace crosses. Various types of ornamental attachment members can be utilized including decorative embroidered patches and removable decals.

A SIXTH EXAMPLE, U.S. Pat. No. 5,438,488, Issued on Aug. 1, 1995, to Dion teaches an article of apparel which includes at least one LED which is intermittently and repetitively turned on. In one form, a hollow ball or shell contains an LED and a digital pulser comprising a battery and a digital oscillator for passing successive pulses of current through the LED. Preferably the shell is made in two separable and halves, to permit easy access to the interior to turn it on or off manually, to repair it, or to replace the battery. In another form, the invention comprises a linear series of LED's on a strip which can be fastened between the laces and tongue of a shoe, the LED's being successively turned on momentarily to produce the appearance of light moving along the strip.

A SEVENTH EXAMPLE, U.S. Pat. No. 6,477,754, Issued on Nov. 12, 2002, to Alexander teaches a decorative device adapted to be slideably attached to a shoelace at its lowermost, horizontally transverse portion as engages the eyelets of a shoe includes a structure foldably adjustable between open and closed states. The structure has a window top portion, a middle portion having display material, and a securing bottom portion. In the close state, the top, middle and bottom portions are in overlying disposition, causing the display material to be visible through the window portion, and forming paired passageways for engaging the shoelace.

It is apparent now that numerous innovations for attachments for footwear having indicia thereon have been provided in the prior art that adequate for various purposes. Furthermore, even though these innovations may be suitable for the specific individual purposes to which they address, accordingly, they would not be suitable for the purposes of the present invention as heretofore described.

SUMMARY OF THE INVENTION

AN OBJECT of the present invention is to provide an ornamental device for footwear that avoids the disadvantages of the prior art.

ANOTHER OBJECT of the present invention is to provide an ornamental device for footwear that is simple and inexpensive to manufacture.

STILL ANOTHER OBJECT of the present invention is to provide an ornamental device for footwear that is simple to use.

BRIEFLY STATED, STILL YET ANOTHER OBJECT of the present invention is to provide an ornamental device for footwear of the type having a plurality of eyelets for a shoelace. The ornamental device comprises a mini bungee cord to engage with two opposite eyelets of the footwear. A decorative component is provided. A mechanism is for removably retaining the decorative component to center of the mini bungee cord.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawings are briefly described as follows.

A MARSHALING OF REFERENCE NUMERALS UTILIZED IN THE DRAWING

Figure 1:
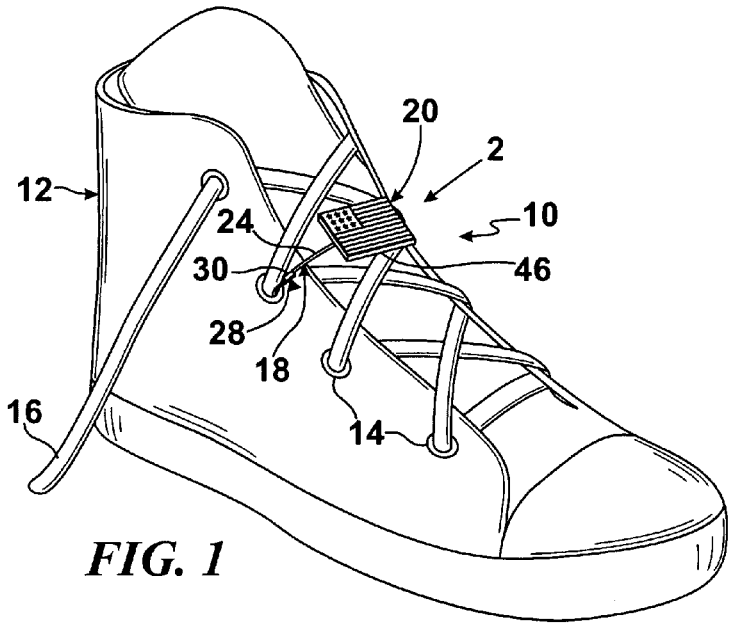
FIG. 1 is a diagrammatic perspective view of an embodiment of the present invention engaged with a typical footwear.

10 ornamental device
12 footwear
14 eyelet of footwear 12
16 shoelace of footwear 12
18 mini bungee cord of ornamental device 10
20 decorative component of ornamental device 10
22 removably retaining mechanism of ornamental device 10
24 elastic cord of mini bungee cord 18
26 hook of mini bungee cord 18
28 attaching mechanism of mini bungee cord 18
29 end of elastic cord 24
30 crimp connector for attaching mechanism 28
32 base member of removably retaining mechanism 22
34 transverse bore in base member 32
36 socket in base member 32
38 seat in socket 36
40 split retainer ring of removably retaining mechanism 22
42 post of removably retaining mechanism 22
44 enlarged head on post 42
46 rear surface of decorative component 20

DETAILED. DESCRIPTION OF THE PREFERRED EMBODIMENT

Figure 2:
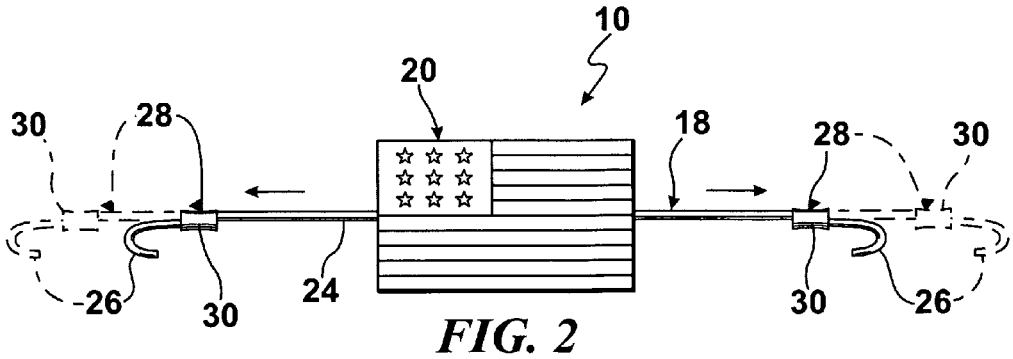
FIG. 2 is an enlarged front view of the present invention per se, taken in the direction of arrow 2 in FIG. 1.
Figure 3:
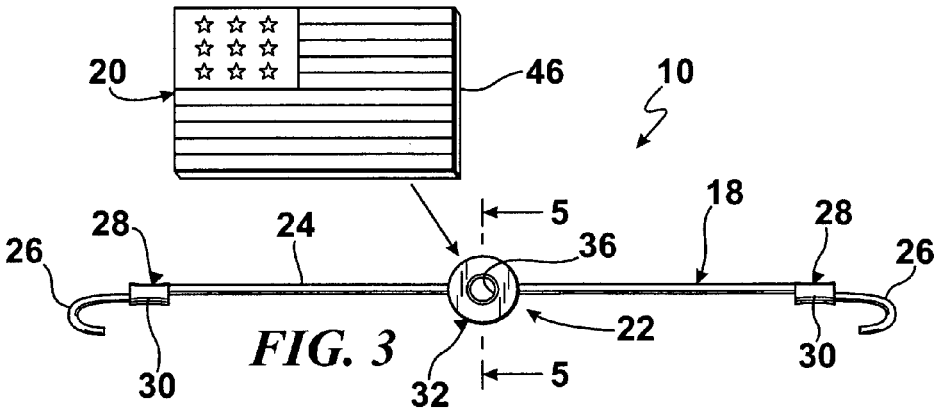
FIG. 3 is an enlarged front view similar to FIG. 2 but with the decorative component shown in perspective and separated therefrom.
Figure 4:
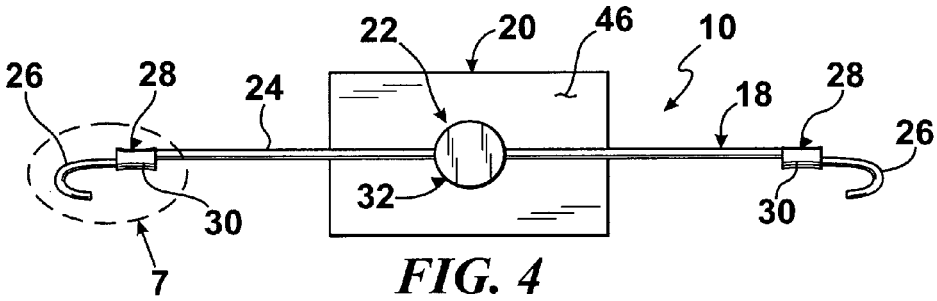
FIG. 4 is an enlarged rear view of the present invention per se.
Figure 5:
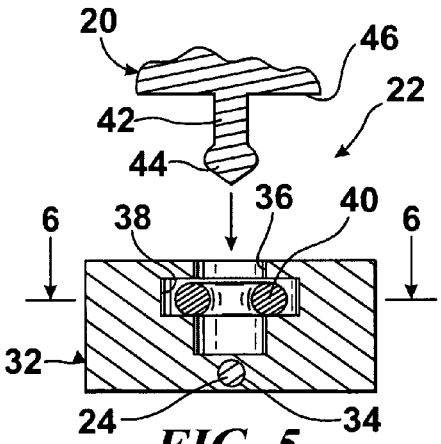
FIG. 5 is an enlarged cross sectional view taken on line 5-5 in FIG. 3.
Figure 6:
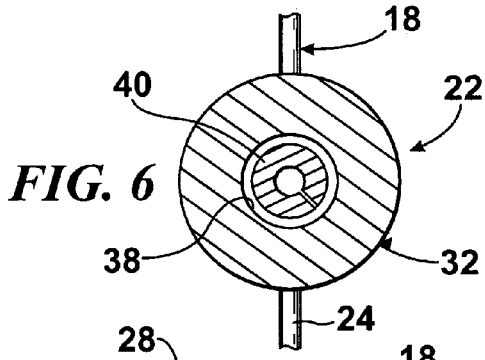
FIG. 6 is a cross sectional view taken on line 6-6 in FIG. 5.
Figure 7:
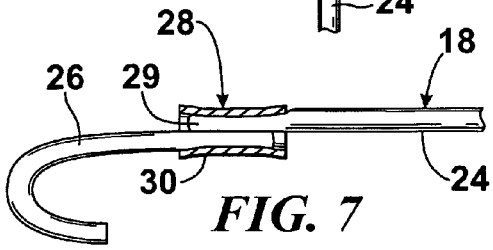
FIG. 7 is an enlarged partial cross sectional view of the area enclosed by the dotted curve indicated by arrow 7 in FIG. 4.

Referring now to the figures, in which like numerals indicate like parts, and particularly to FIGS. 1 through 7, which are a diagrammatic perspective view of an embodiment of the present invention engaged with a typical footwear; an enlarged front view of the present invention per se, taken in the direction of arrow 2 in FIG. 1; an enlarged front view similar to FIG. 2 but with the decorative component shown in perspective and separated therefrom; an enlarged rear view of the present invention per se; an enlarged cross sectional view taken on line 5-5 in FIG. 3; a cross sectional view taken on line 6-6 in FIG. 5; and an enlarged partial cross sectional view of the area enclosed by the dotted curve indicated by arrow 7 in FIG. 4, and as such, will be discussed with reference thereto.

The present invention is an ornamental device 10 for footwear 12 of the type having a plurality of eyelets 14 for a shoelace 16. The ornamental device 10 comprises a mini bungee cord 18 to engage with two opposite eyelets 14 of the footwear 12. A decorative component 20 is provided. A mechanism 22 is for removably retaining the decorative component 20 to center of the mini bungee cord 18.

The mini bungee cord 18 comprises an elastic cord 24. A pair of hooks 26 are provided. A mechanism 28 is for attaching each hook 26 to an end 29 of the elastic cord 24. The attaching mechanism 28 is a crimp connector 30.

The removably retaining mechanism 22 comprises a base member 32 having a transverse bore 34 which allows the elastic cord 24 of the mini bungee cord 18 to pass therethrough. The base member 32 also has a socket 36 with a seat 38 therein above the transverse bore 34. A split retainer ring 40 is carried within the seat 36 of the socket 34 of the base member 32. A post 42 having an enlarged head 44 centrally extend from a rear surface 46 of the decorative component 20. When the post 42 is inserted into the socket 36 and the enlarged head 44 passes the split retainer ring 40, the decorative component 20 will be held to the base member 32.

The decorative component 20 of the ornamental device 10, can have any sort of character, cartoon, image, words or flag thereon. The decorative component 20 can be made in a variety of shapes and sizes, such as a heart, rectangle, star, square, three dimensional configuration, etc. The decorative component 20 can also swivel from a horizontal to a vertical position and be detached from and replaced onto the base member 32 when needed, so as to be interchangeable.

The hooks 26 of the mini bungee card 18 will normally engage with the eyelets 14 of the footwear 12, but they can also engage with the shoelace 16. The ornamental device 10 can be utilized on shoes and sneakers or become a bracelet.

It will be understood that each of the elements described above, or two or more together, may also find a useful application in other types of constructions differing from the types described above.

While the invention has been illustrated and described as embodiments of an ornamental device for footwear, accordingly it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. An ornamental device for footwear of the type having a plurality of eyelets for a shoelace, said ornamental device comprising:

a) a mini bungee cord to engage with two opposite eyelets of the footwear;

b) a decorative component; and c) means for removably retaining said decorative component to center of said mini bungee cord;

wherein said mini bungee cord comprises:

i) an elastic cord;

ii) a pair of hooks; and iii) means for attaching each said hook to an end of said elastic cord; and wherein said removable retaining means comprises:

A) a base member having a transverse bore which allows said elastic cord of said mini bungee cord to pass therethrough, said base member also having a socket with a seat therein above said transverse bore;

B) a split retainer ring carried within said seat of said socket of said base member; and C) a post having an enlarged head centrally extends from a rear surface of said decorative component, wherein when said post is inserted into said socket and said enlarged head passes said split retainer ring, said decorative component is held to said base member.

2. The ornamental device as recited in claim 1, wherein said attaching means comprises a crimp connector.

* * * * *